US005308208A

United States Patent [19]

Ranson

[11] Patent Number: 5,308,208

[45] Date of Patent: May 3, 1994

[54] METHOD FOR BINDING A BOOK

[75] Inventor: Rodger Ranson, Winchester, Ill.

[73] Assignee: Hertzberg-New Method, Inc., Jacksonville, Ill.

[21] Appl. No.: 49,680

[22] Filed: Apr. 16, 1993

Related U.S. Application Data

[60] Division of Ser. No. 850,223, Mar. 12, 1992, Pat. No. 5,203,590, which is a continuation of Ser. No. 606,441, Oct. 31, 1990, abandoned.

[51] Int. Cl.[5] ..... B42C 11/00

[52] U.S. Cl. ..... 412/5; 412/3; 412/6; 412/8

[58] Field of Search ..... 412/3-8, 412/21, 35; 402/8, 25; 281/21.1, 29; 462/17, 55

[56] References Cited

U.S. PATENT DOCUMENTS

| | | | |
|---|---|---|---|
| 2,379,971 | 7/1945 | Krehbiel | 412/21 X |
| 3,137,874 | 6/1964 | Hildmann et al. | 412/3 |
| 3,161,423 | 12/1964 | Hertzberg | 281/21.1 X |
| 3,314,089 | 4/1967 | Margolis et al. | 412/3 |
| 3,318.618 | 5/1967 | Mullen et al. | 281/29 |
| 3,454,694 | 7/1969 | Delaire et al. | 412/3 X |
| 3,708,813 | 1/1973 | Carter et al. | 412/5 |
| 3,749,422 | 7/1973 | Abildgaard et al. | 281/29 X |
| 3,802,723 | 4/1974 | Watson | 281/29 X |
| 3,884,742 | 5/1975 | Roberts | 412/1 X |
| 3,912,304 | 10/1975 | Abildgaard et al. | 281/29 X |
| 3,925,126 | 12/1975 | Leatherman et al. | 412/5 X |
| 3,964,769 | 6/1976 | Shatzkin | 281/29 X |
| 3,972,764 | 8/1976 | Sendor | 412/17 X |
| 4,091,487 | 5/1978 | Axelrod | 412/5 |
| 4,367,061 | 1/1983 | Wiholm | 412/3 |
| 4,642,086 | 2/1987 | Howarth, Jr. . | |
| 4,906,156 | 3/1990 | Axelrod | 412/8 X |
| 5,203,590 | 4/1993 | Ranson | 281/21.1 |

FOREIGN PATENT DOCUMENTS

| | | | |
|---|---|---|---|
| 796063 | 6/1958 | United Kingdom | 412/3 |

*Primary Examiner*—Peter Dungba Vo
*Attorney, Agent, or Firm*—Olson & Hierl, Ltd.

[57] ABSTRACT

A method for binding the book and an apparatus for forming the book cover are disclosed. The forming apparatus comprises a base portion, an anvil member supported by the base portion and a forming bar, preferably heated, which is operatively associated with the anvil member. In operation, the forming bar engages the anvil member, and the cooperation of the forming bar and the anvil member defines the shape of the spine of a book cover positioned therebetween. Reinforced end sheets are secured to a plurality of pages which are then secured by adhesive means to the formed book cover. The book cover so formed securely holds the pages and secures the spine of the book in a durable construction.

2 Claims, 2 Drawing Sheets

METHOD FOR BINDING A BOOK

CROSS REFERENCE TO RELATED APPLICATION

This application is a division of co-pending application Ser. No. 850,223, filed on Mar. 12, 1992, now U.S. Pat. No. 5,203,590, which is a continuation of application Ser. No. 606,441, filed on Oct. 31, 1990, now abandoned.

TECHNICAL FIELD

The present invention relates generally to the binding of books and, more specifically, to an apparatus and method for producing a bound book. The invention also relates to the book so produced.

BACKGROUND OF THE INVENTION

The paperback book has become a fixture of many publishers and bookstores. The term "paperback" refers to the cover of a book which generally comprises a heavier paper than the bound printed pages. A paperback cover is flexible, lightweight and can be manufactured at a much lower cost than a conventional hardcover book. The term "hardcover" refers to the rigid, thick and more expensive stiffened cloth or board cover most often found on permanent volumes.

A paperback book offers several advantages over a hardcover book including, inter alia, a lower cost to manufacture, lower cost to the consumer and a reduced shipping weight. In fact, the price of a paperback book makes the book essentially a throwaway item. Being inexpensive, the paperback book has allowed persons who normally could not afford a hardcover version of a book to purchase the paperback version. Thus, over the years, the paperback book has generally made reading materials more accessible to the public.

Libraries, schools and other volume purchasers of reading materials would also like to use paperback volumes because of the cost savings. For the price of one hardcover volume, a purchaser could buy two or more paperback volumes and thus have a larger collection for about the same cost.

However, these volume purchasers are also aware that a paperback volume is far less durable than the hardcover version. As a result, any savings made at the initial purchase would eventually be lost as the volume consumer was forced to purchase replacement volumes when the originals wore out from use. As a result, the use of paperback volumes by volume consumers has been somewhat limited.

This has been particularly true with the market for flat back books. The term "flat back" refers to any book having a total page thickness generally less than about three eighths of an inch and which is not rounded or backed. These books are typically children's books although other types are available. Quite often, flat back books are also found in hardcover versions.

As a result, there is a need in the industry for a method of substituting a more durable cover for the standard paperback cover found on flat bound and other types of books. The method should also be suitable for replacing hardcovers on bound books. In addition, the cost of substitution must be at a price which does not exceed the cost of a hardcover version of the book in the first place. The present invention meets these needs.

SUMMARY OF THE INVENTION

A book, a book cover, a method for binding the book and an apparatus for forming the corresponding book cover are disclosed.

The forming apparatus comprises a base portion, an anvil member supported by the base portion and a forming bar, preferably heated, which is movably supported relative to the anvil member. The forming bar is adapted to engage the anvil member whereby the cooperation of the forming bar and the anvil member defines the desired shape of the spine of the book cover as described below.

In operation, the central portion of a flat book cover is placed in the forming apparatus between the anvil member and the forming bar, and the shaped spine or channel is formed in the desired configuration. The book cover includes a cover sheet, a pair of opposed and spaced-apart support panels or boards secured to the cover sheet and a foldable pad member or spine strip secured to the cover sheet between the support boards.

In order to secure the pages of a book within the book cover so formed, the original cover of the book is first removed to expose the pages. The pages define a book block preferably having a thickness of about three eighths of an inch or less. Along one edge of the book block, the pages are bound together. The book block is secured between a pair of end sheets which can include a fabric reinforced portion.

The pages with the end sheets secured thereto are then inserted within the shaped spine or channel of the book cover, and the end sheets are secured by an adhesive to the corresponding support panels and the spine. The book cover thus provides protection that is equivalent to that of a hardcover book.

BRIEF DESCRIPTION OF THE DRAWINGS

In the accompanying drawings, which comprise a portion of this disclosure.

DESCRIPTION OF THE PREFERRED EMBODIMENT

The forming apparatus, book and book cover of this invention can be assembled and used in many different forms. This detailed description and the accompanying drawings disclose only one specific form which provides an example of a preferred embodiment. The particular shapes and sizes described are not essential to the invention unless otherwise indicated. Moreover, the invention is not intended to be limited to the particular embodiment illustrated.

For ease of reference, the present device is described in a normal operating position. It will be understood, however, that the device may be used in an orientation other than the particular position described.

Figure 1:
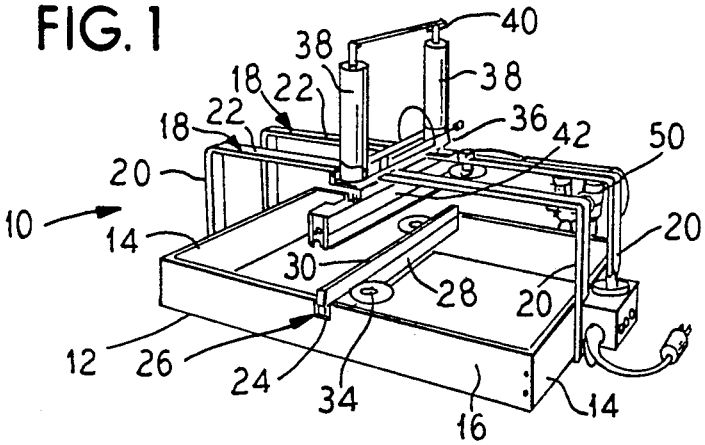
FIGS. 1–3 are perspective views and partial perspective views showing the construction and sequence of operation of the present apparatus.

Turning to FIG. 1, the forming apparatus 10 preferably includes a base portion 12. The base portion 12, as illustrated, includes a pair of side members 14 disposed between a pair of somewhat longer side members 16. A pair of U-shaped support members 18 is mounted such that the upright members 20 thereof are connected to the corresponding sides 14 of the base portion 12. A cross brace 22 associated with each U-shaped support member 18 extends between the corresponding upright members 20 over the base portion 12.

Opposed cutaway portions 24 are defined in the sides 16 of the base portion 12. The ends of an anvil member 26 are removably but securely received within the corresponding cutaway portions 24 such that the anvil member extends across the base portion 12 between the sides 16. The anvil member 26 preferably comprises an anvil supporting component 28 and an anvil 30.

Figure 4:
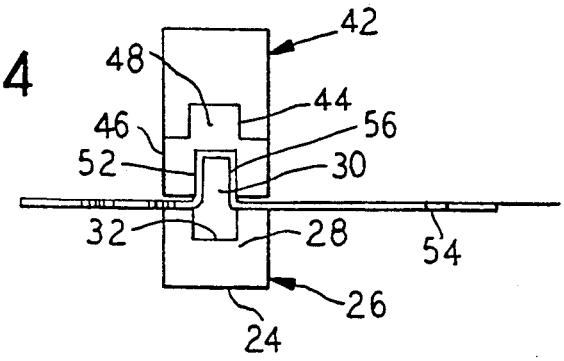
FIG. 4 is a partial elevational view of a book cover formed using the present apparatus.

With particular reference to FIG. 4, the anvil supporting component 28 is removably mounted within the cutaway portions 24 and defines a channel 32 within which the anvil 30 is securely positioned. The anvil 30 thus extends completely across the base portion 12 and presents a rectangular cross section above the anvil supporting component 28. The anvil 30 is preferably about ⅛" to about ⅜" wide.

It is preferred that several anvil members 26 are supplied, each anvil member 26 having a different width or shape. The various anvil members 26 can be easily interchanged which allows the operator to quickly adapt the apparatus to form covers for books, as described herein, having different thicknesses. Moreover, gripping means 34 in the form of a fingerhold can be provided to more easily position the anvil member 26 relative to the apparatus.

Supported by the U-shaped support members 18 and positioned directly above the anvil member 26 is a transversely mounted cross member 36. Compression means comprising at least one, and preferably two, pneumatic cylinder/piston assemblies 38 is mounted on the cross member 36 directly above and in alignment with the anvil member 26. Air lines 40 are provided to supply high pressure air which drives the pistons within the cylinders.

Figure 2:
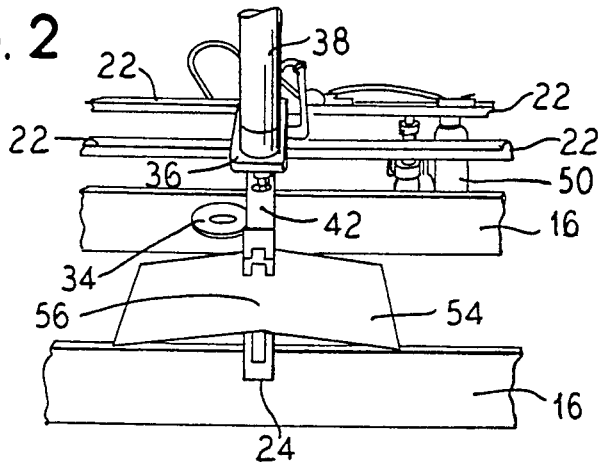
Figure 3:
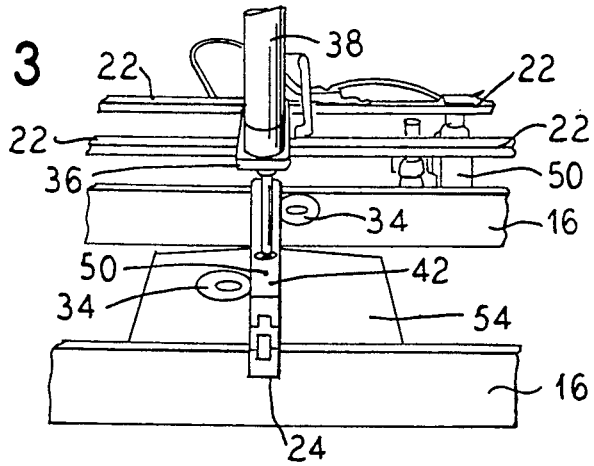

A heating member 42 is operatively connected to the pistons of the cylinder/piston assembles 38 as shown in FIGS. 1–3. The heating member 42 defines a U-shaped support channel 44. (See FIG. 4.) A forming bar 46 (made of metal) is mounted on the heating member 42 through a rectilinear member 48 which mates with the U-shaped support channel 44. Preferably, two screws (not shown), whose heads are accessible through holes 50 cut into the top of the heating member 42 (see FIG. 3) are threadably received by corresponding holes (not shown) in the forming bar 46 to hold the heating member 42 and the forming bar 46 together. The use of the easily accessible screws in which join the heating member 42 and the forming bar 46 is intended to also facilitate adapting the apparatus to form covers of different thicknesses. Gripping means 34 can also be provided to properly position the forming bar 46 relative to the heating member.

The heating member 42 includes a heating element (not shown) operated by a power source 50. The heating element warms the heating member 42 and the forming bar 46 to a temperature that is sufficient to soften the cover member and render it pliable without scorching.

The forming bar 46 preferably defines a substantially U-shaped channel 52 which receives and corresponds to the shape of the anvil 30 of the anvil member 26 during the formation of a book cover according to this invention. In operation, the forming bar 46 and the anvil 30 do not actually make contact (according to a preferred embodiment) but are spaced apart a distance about equal to the thickness of the book cover when the compression means is fully extended. Providing a space between these components lessens the risk of damaging the cover member by applying too great a pressure against the central portion of the book cover.

FIGS. 1–4 illustrate the sequence of operation that is employed to form a book cover used in the present apparatus. Specifically, referring again to FIG. 1, a book cover 54 is placed within the apparatus so that the central portion 56 of the cover is positioned directly over the anvil member 26. As shown in FIG. 2, the heated forming bar 46 is driven downwardly by the pneumatic cylinder/piston assembly 38 to engage the central portion 56 of the book cover. FIG. 3 shows the engagement of the forming bar and the anvil with the book cover positioned therebetween. FIG. 4 is a more detailed view of the book cover so formed.

Turning now to FIGS. 5*a* through 5*h*, the steps in the procedure for forming a book according to the present invention are illustrated.

Figure 5A:
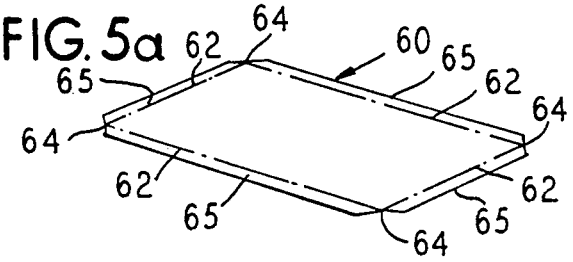
FIGS. 5*a*–5*h* are perspective views showing the sequential steps in the formation of a book cover and a book according to the present invention.

In FIG. 5*a*, a generally rectangular cover sheet 60 is shown. The cover sheet can comprise any suitable material such as cloth, buckram or a thermoplastic material including a laminated polyester film material, and forms the outer case or cover of the bound book. The outer surface of cover sheet 60 will generally include printing or artwork to identify the book as desired.

Fold lines 62 are positioned parallel to each of the sides of the rectangle at an incremental distance towards the center of the rectangular cover sheet 60. Preferably, each corner 64 of the cover sheet 60 is trimmed at a 45 degree angle through the intersection of the fold lines 62 at the particular corner 64. Thus, flaps 65 are formed.

Figure 5B:
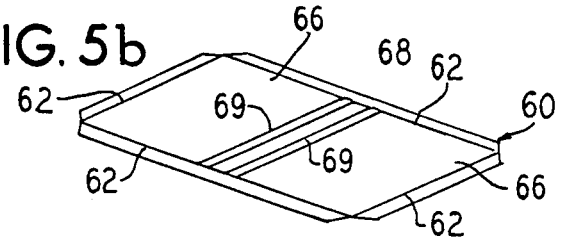

Referring to FIG. 5*b*, support boards 66 in the form of panels or plates and a pad member in the form of a foldable spine strip 68 are placed on the inner surface of the cover sheet 60. The support boards 66 and the foldable spine strip 68 are preferably made of cardboard although other suitable materials could also be utilized as will be appreciated by those skilled in the art. The support boards 66 are positioned opposite each other at about the fold lines 62 as shown. The foldable spine strip 68 is centered on the cover sheet 60 between the support boards 66 and is also at about the fold lines 62. Preferably, an adhesive is applied between the support boards 66 and the cover sheet and between the spine strip 68 and the cover sheet. Hinge members 69 are defined on the cover sheet in the regions between the support boards 66 and the spine strip 68.

Figure 5C:
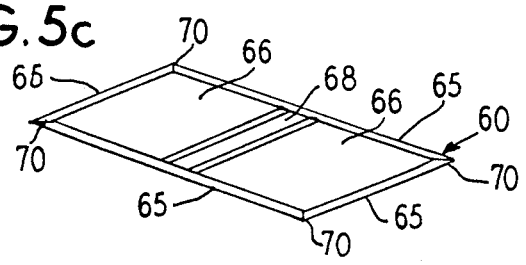

The flaps 65 are then folded over the support boards 66 and the spine strip 68 as shown in FIG. 5*c*. The trimmed corners 64 allow each flap 65 to abut its adjoining flaps 65 along lines 70. The flaps 65 are adhered to the corresponding support boards 66 and the spine strip 68 with an appropriate adhesive.

The cover sheet 60 which now includes support boards 66 and the foldable spine strip 68 defines the cover member 54 and is positioned within the forming apparatus 10 as described above. The cover member is inverted so that the support boards 66 and the spine strip 68 comprise the lower surface thereof. The cover member is also positioned so that the spine strip 68 is parallel to and is centered over the anvil 30.

Referring again to FIGS. 1–4, a shaped spine or channel 72 is formed along the central portion 56 of the cover member at the location of the foldable spine strip 68. After the channel 72 is formed, the cylinder/piston assembly 38 lifts the forming bar 46 off the anvil 30 and the formed cover member 54 can be removed from the apparatus.

Figure 5D:
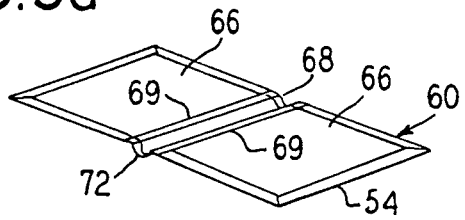

FIG. 5*d* shows the resulting book cover. The dimensions of the shaped spine or channel 72 are defined by the configuration of the anvil 30 and the U-shaped channel 52 of the forming bar 46. As shown, the hinge members 69 are positioned between the foldable spine strip 68 and the adjacent support boards 66.

Figure 5E:
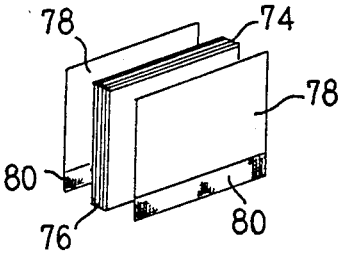
Figure 5F:
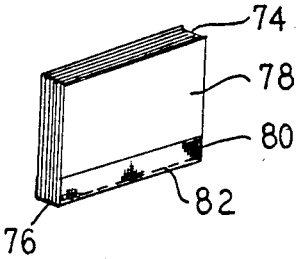

Turning to FIG. 5*e*, a plurality of pages 74 from a book are shown. The pages 74 are bound together along an edge 76 with stitching or with an adhesive. A pair of end sheets 78 are shown. Reinforcing members comprising fabric strips 80 may be included on the end sheets 78 adjacent the edge 76 to provide additional strength. In a preferred embodiment, the end sheets 78 are joined to the pages 74 through the fabric strips 80 by stitches 82 as shown in FIG. 5*f*. The distance between the edge 76 and the stitches 82 is preferably slightly greater than the depth of the channel 72 of the cover member.

Figure 5G:
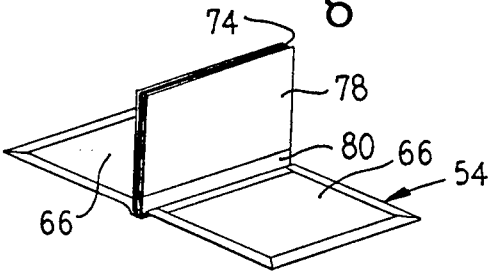
Figure 5H:
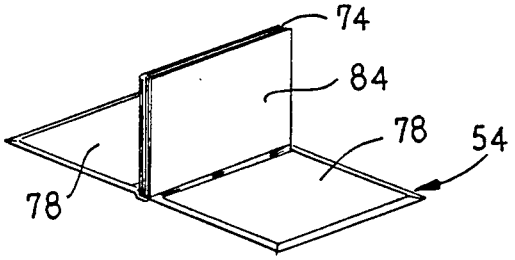

During assembly, the secured edge 76 of the pages 74 is placed in the shaped spine or channel 72 of the cover member as shown in FIG. 5*g*. The end sheets 78 are then folded down against the support boards 66 to expose an adjacent liner page 84 of the book, and are secured to the support boards with an adhesive as shown in FIG. 5*h* to form the finished book. Preferably, the end sheets 78 are sized to overlap the flaps 65 when folded, but do not extend beyond the outer edges of the cover member.

Figure 6:
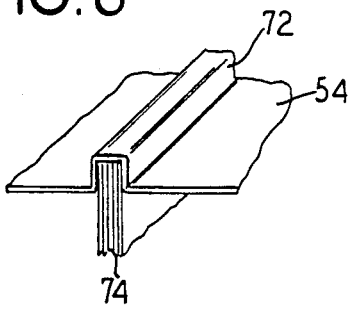
FIG. 6 is a partial perspective view of a book so produced.

FIG. 6 is an enlarged partial view of a book formed according to the present invention. The cover member as shown securely holds the pages of the book locking it into the spine to provide a particularly durable construction.

The foregoing is illustrative of the principles of this invention. However, numerous modifications and changes will be readily apparent to those skilled in the art. It should be understood that the invention is not limited to the particular construction and the sequence of operation described. Accordingly, all suitable modifications and equivalents within the spirit of this invention should be interpreted as falling within the scope of the following claims.

What is claimed is:

1. A method for binding a book comprising the steps of:

(a) first positioning a pair of end sheets so that each one is adjacent a different one of the respective opposed faces of a stack that is comprised of a plurality of adjacent pages and which has a straight side at which respective edge portions of each page are generally aligned, each one of said pair of end sheets having an associated edge portion that extends generally along said side, and each one of said edge portions including a reinforcing fabric strip;

(b) stitching together all of said pages and said end sheets at said edge portions in laterally spaced relationship to said side, said stitching extending transversely through said pages, said fabric strips and said end sheets, thereby producing a stitched assembly of said end sheets and said stack having a stitched side;

(c) secondly positioning said assembly so that said stitched side is located in a generally U-shaped channel existing in the transverse mid-region of a preformed book cover, said book cover comprising (1) a generally rectangular cover sheet member having opposed inner and outer faces and having inwardly foldable flap members defined along perimeter edge portions thereof;

(2) a foldable spine strip with opposed longitudinal sides that is centrally located adjacent said inner face and extends transversely thereacross;

(3) a pair of support boards each located adjacent said inner face and positioned in spaced, adjacent relationship to a different one of said longitudinal sides of said spine strip;

(4) said flap members being folded over adjacent peripheral portions of said spine strip and of each one of said support boards; and (5) adhesive means bonding said cover sheet and said flaps to said spine strip and to said support boards; so that, in the resulting book cover, said spine strip and adjacent bonded portions of said cover sheet are together definable into said generally U-shaped channel wherein;

said second positioning being carried out so that the resulting interrelationship between said assembly and said generally U-shaped channel is such that said generally U-shaped channel extends around said stitched side and over said stitching in said edge portions;

(d) folding each one of said end sheets outwardly into contacting adjacent associated relationship with a different one of each of said support boards; and (e) adhesively bonding contacting portions of each one of said end sheets to its adjacent associated said support board, thereby binding said assembly to said book cover.

2. The method of claim 1 wherein said preformed book cover is prepared by the steps comprising:

(a) locating said foldable spine strip with said opposed longitudinal sides centrally adjacent said inner face of said cover sheet member so as to extend transversely across said cover sheet member;

(b) locating each member of said pair of support boards adjacent said inner face of said cover sheet member and positioned in spaced, adjacent relationship to a different one of said opposed longitudinal sides of said spine strip;

(c) folding said flap members of said cover sheet over adjacent peripheral portions of said spine strip and of each one of said support boards; and (d) adhesively bonding said cover sheet and said flaps to said spine strip and to said support boards.

* * * * *